United States Patent [19]

Ting

[11] Patent Number: 4,934,701

[45] Date of Patent: Jun. 19, 1990

[54] PUZZLE IN WHICH VARIOUS PIECES FORM A MULTI-LAYERED STRUCTURE

[76] Inventor: Victor G. Ting, Lot 40, Blk. 1, Sn. Sebastian Heights Subd. Sn. Vincente, Tarlac, 2300 Tarlac, Philippines

[21] Appl. No.: 322,414

[22] Filed: Mar. 13, 1989

[51] Int. Cl.[5] ..... A63F 9/10

[52] U.S. Cl. ..... 273/157 R; 273/160

[58] Field of Search ..... 273/157 R, 160

[56] References Cited

U.S. PATENT DOCUMENTS

| | | | |
|---|---|---|---|
| 1,578,225 | 3/1926 | White | 273/157 R X |
| 1,964,007 | 6/1934 | Parks | 273/157 R |
| 2,694,265 | 11/1954 | Way | 273/160 UX |
| 3,565,442 | 2/1971 | Klein | 273/157 R |
| 4,133,538 | 1/1979 | Ambrose | 273/157 R X |
| 4,257,609 | 3/1981 | Squibbs | 273/157 R X |
| 4,323,245 | 4/1982 | Beaman | 273/157 R |

OTHER PUBLICATIONS

Ting Unpublished Copyright in Philippines, Reg. date 3/28/88.

*Primary Examiner*—Edward M. Coven
*Assistant Examiner*—Raleigh W. Chiu
*Attorney, Agent, or Firm*—William D. Hall

[57] ABSTRACT

A puzzle is provided in which several layers form a pyramid or similar configuration. The device has a base for supporting five layers of pieces. Each of the first three of these layers comprise corner pieces at each corner. Between the corner pieces, of each of the three layers, are side pieces. The first layer has three, the second layer two, and the third layer one side piece(s) between each pair of corner pieces. The inner sides of the side pieces, of the three layers, mate with center piece(s) to present a problem to the person assembling the puzzle. Above the third layer is the fourth layer comprising four corner pieces. The fifth layer is a single piece constituting a crown.

21 Claims, 6 Drawing Sheets

T
S
W
UW

T
S
W
UW
90

S
CP
60
61

T
S
W
UW

S
61
61
S

PUZZLE IN WHICH VARIOUS PIECES FORM A MULTI-LAYERED STRUCTURE

BACKGROUND OF THE INVENTION

A puzzle in which a number of blocks of various shapes may be assembled to form a pyramid is shown in U.S. Pat. No. 4,323,245, granted Apr. 6, 1982 to Robert D. Beaman and in U.S. Pat. No. 3,565,442, granted Feb. 23, 1971, to Burton L. Klein. Another U.S. Pat. No. 4,133,538 issued Jan. 9, 1979, to David W. Ambrose, is entitled Pyramid Building Game. A further illustration of a pyramid assembled with a plurality of cubes is set forth in U.S. Pat. No. 4,257,609, issued Mar. 24, 1981 to Robert F. Squibbs entitled Games and Puzzles.

SUMMARY OF THE INVENTION

The invention relates to puzzles and more particularly to a puzzle that forms a desired configuration, such as (a) the frustum of a solid body, or (b) a pyramid.

The form of the invention disclosed in the drawings employs a base. Above the base are two or more layers each having corner pieces. In each layer there are side pieces, which have inner walls of different shape. Furthermore, in each layer, the side pieces mate with center piece(s) so that the side and center pieces will only mate with each other in a predetermined way to form the layer of the frustum or pyramid.

Each layer nests with the layers above and below it to provide the frustum or pyramindal shape.

In the form of the puzzle shown in the drawings there are fourth and fifth layers which are easy to install and are not required for the practice of the claimed invention.

DETAILED DESCRIPTION OF THE INVENTION

Figure 1:
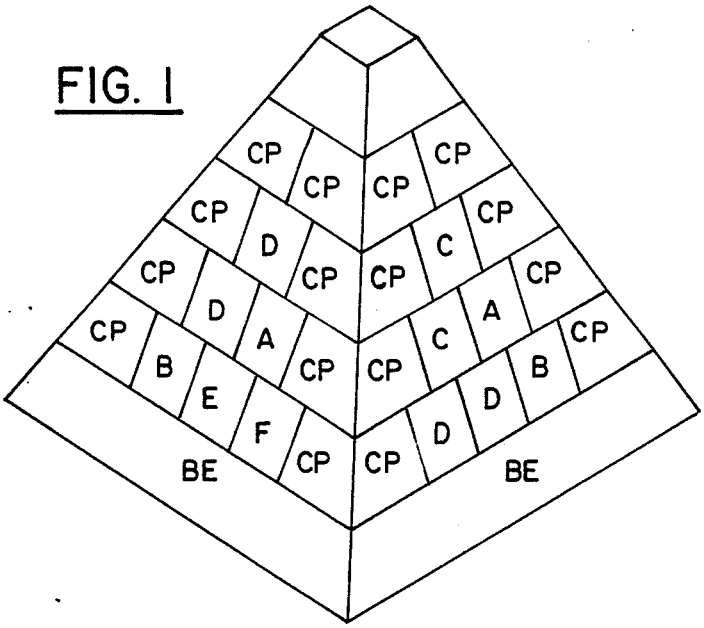
FIG. 1 is a perspective view of an assembled Frustum Puzzle.
Figure 3:
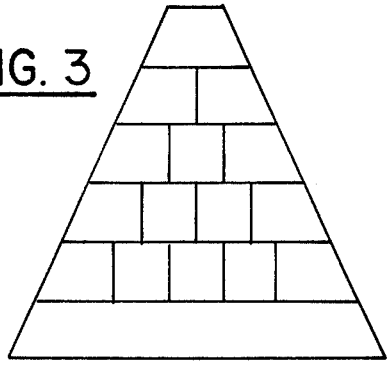
FIG. 3 is a side view of an assembled Frustum Puzzle.
Figure 2:
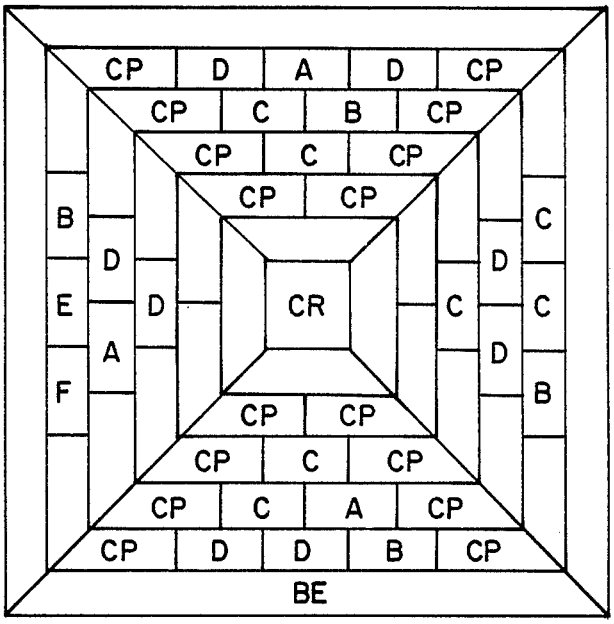
FIG. 2 is a top view of an assembled Frustum Puzzle.
Figure 4:
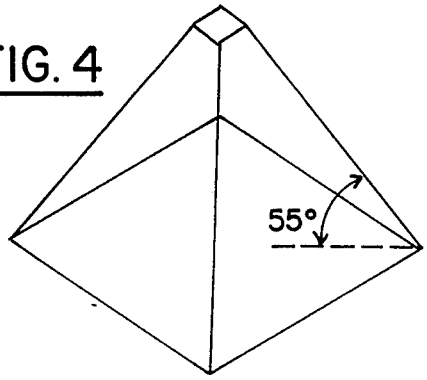
FIG. 4 illustrates the inward angle of an assembled Frustum Puzzle.
Figure 5:
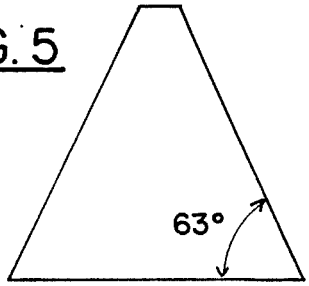
FIG. 5 illustrates the side view angle of an assembled Frustum Puzzle.

The Frustum Puzzle of this invention is shown in assembled form in FIGS. 1, 2 and 3.

Figures 6, 6A, 6B, 6C, 7, 7A, 7B, 7C, 8, 8A, 8B, 8C, 9, 9A, 9B, 9C:
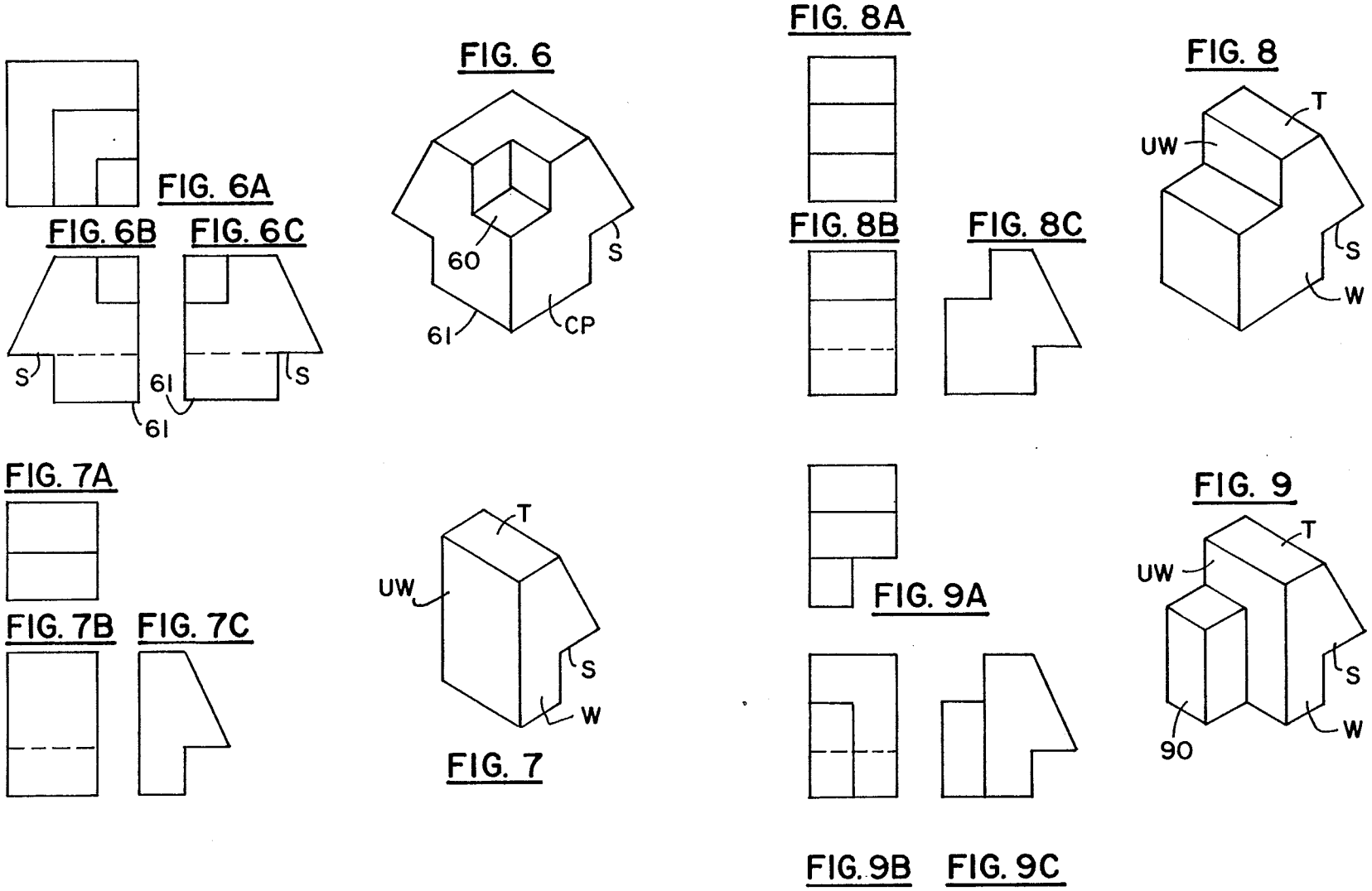
FIG. 6 is a perspective view of a corner piece of the Frustum Puzzle.
FIG. 6*a* is a top view of the corner piece of FIG. 6.
FIG. 6*b* is an inside view of the corner piece of FIG. 6, looking from the left of FIG. 6.
FIG. 6*c* is an inside view of the corner piece of FIG. 6, looking from the right of FIG. 6.
FIG. 7 is a perspective view of side piece A of the Frustum Puzzle.
FIG. 7*a* is a top view of side piece A (shown in FIG. 7).
FIG. 7*b* is an inside, or rear, view of side piece A (see FIG. 7).
FIG. 7*c* is a side view of side piece A of FIG. 7.
FIG. 8 is a perspective view of side piece B of the Frustum Puzzle.
FIG. 8*a* is a top view of side piece B.
FIG. 8*b* is an inside or rear view of side piece B of FIG. 8.
FIG. 8*c* is a side view of side piece B of FIG. 8.
FIG. 9 is a perspective view of side piece C of the Frustum Puzzle.
FIG. 9*a* is a top view of side piece C of FIG. 9.
FIG. 9*b* is an inside, or rear, view of side piece C of FIG. 9.
FIG. 9*c* is a side view of side piece C of FIG. 9.
Figure 12:
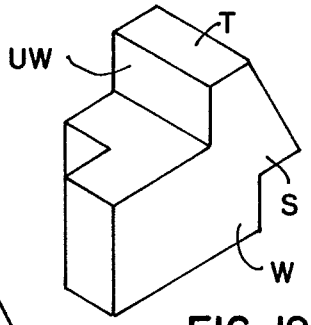
FIG. 12 is a perspective view of side piece E of the Frustum Puzzle.
Figure 12A:
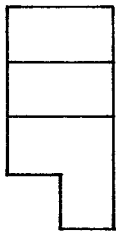
FIG. 12*a* is a top view of side piece E of FIG. 12.
Figure 12B:
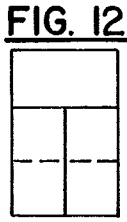
FIG. 12*b* is an inside, or rear view of side piece E of FIG. 12.
Figure 12C:
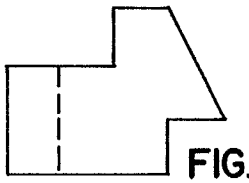
FIG. 12*c* is a side view (looking from the right of FIG. 12) of side piece E.
Figure 13:
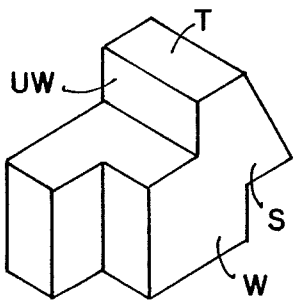
FIG. 13 is a perspective view of side piece F of the Frustum Puzzle.
Figure 13A:
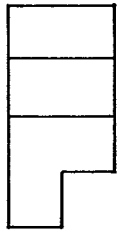
FIG. 13*a* is a top view of side piece F of FIG. 13.
Figure 13B:
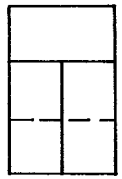
FIG. 13*b* is an inside, or rear, view of side piece F of FIG. 13.
Figure 13C:
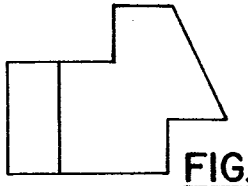
FIG. 13*c* is a side view of side piece F of FIG. 13.
Figure 22:
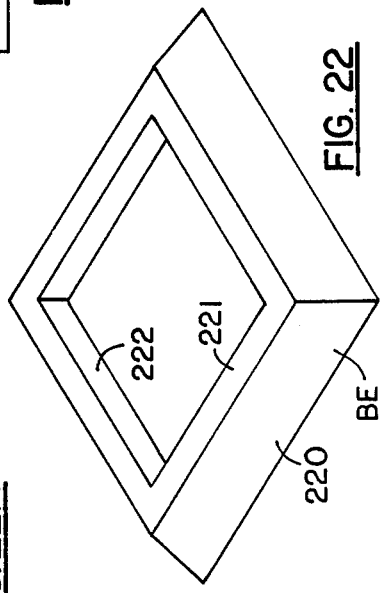
FIG. 22 is a perspective view of the base of the Frustum Puzzle.
Figure 20:
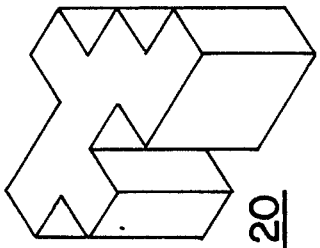
FIG. 20 is a perspective view of center piece GG of the Frustum Puzzle.
Figure 21:
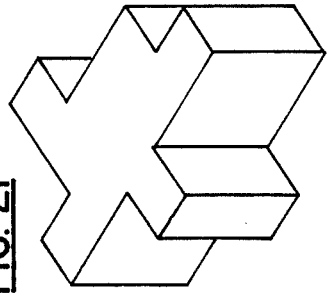
FIG. 21 is a perspective view of center piece HH of the Frustum Puzzle.
Figure 20A:
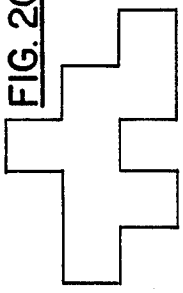
FIG. 20*a* is a top view of center piece GG of FIG. 20.
Figure 21A:
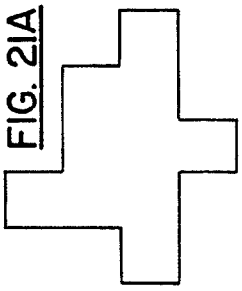
FIG. 21*a* is a top view of center piece HH of FIG. 21.
Figure 22A:
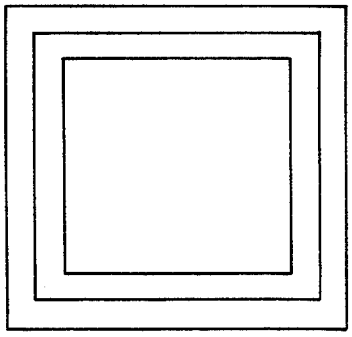
FIG. 22*a* is a top view of the base of the Frustum Puzzle.
Figure 22B:
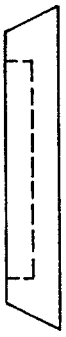
FIG. 22*b* is a side view of the base of FIG. 22.

The pieces that are used to assemble the puzzle comprise the base of FIG. 22, corner pieces CP of FIG. 6, and six different shapes of side pieces, A, B, C, D, E and F shown in FIGS. 7 to 10, 12 and 13, respectively. There is also a crown piece CR of FIG. 11. In addition there are eight center pieces AA to HH shown in FIGS. 14–21 incl. Preferred dimensions in inches, are shown in the drawings for each piece.

Figure 25:
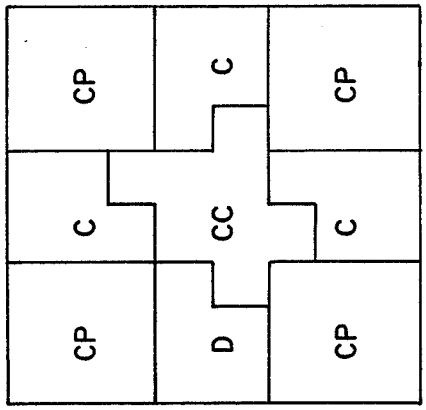
FIG. 25 is a top view of an assembly of pieces constituting the third level of the Frustum Pyramid of FIG. 1.
Figure 24:
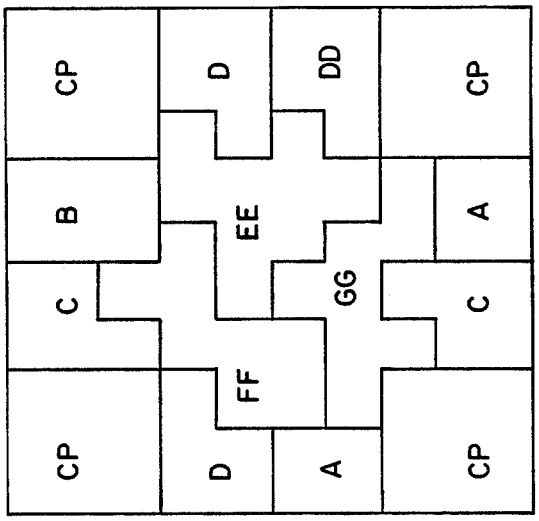
FIG. 24 is a top view of an assembly of pieces constituting the second level of the Frustum Pyramid of FIG. 1.
Figure 23:
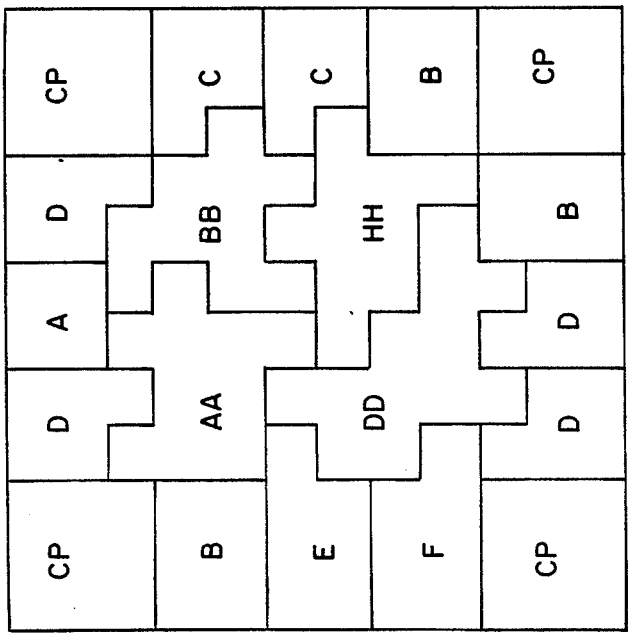
FIG. 23 is the top view of an assembly of pieces consisting of the first level (the level immediately above the base) of the Frustum Pyramid of FIG. 1.

In some instances the center pieces of FIGS. 14 to 21 are upside down from the ones shown in FIGS. 23 to 25.

The base BE of FIG. 22 has an outer side wall 220 and a flat horizontal top side 221 and a vertical inner wall 222.

Each of the corner pieces CP (FIG. 6), and each of the side pieces (FIGS. 7–10, 12, 13) has a shelf S capable of resting on the top 221 of the base BE. Each corner piece CP has a surface 60 on which a portion of the square base 61 of another corner piece CP may rest.

Each of the side pieces A to F (FIGS. 7 to 10, 12 and 13) has a vertical inner wall W which mates with the inner wall 222 of the base BE or with upper wall UW of any other side piece.

As shown in FIGS. 1 to 3, there are five layers of pieces above the base BE.

FIG. 23 is a top view of the first level. It has four corner pieces CP and twelve side pieces all of which rest on and nest with the base in the manner described above. The letter marked on each side piece designates which of the six side pieces of FIGS. 7–10, 12 and 13 is used. In addition the first level also includes center pieces AA, BB, DD and HH of FIGS. 14, 15, 17 and 21 respectively.

Figure 10:
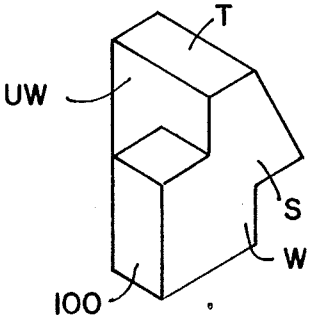
FIG. 10 is a perspective view of side piece D of the Frustum Puzzle.
Figure 15:
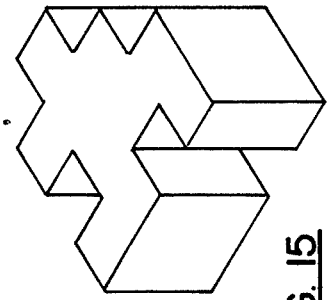
FIG. 15 is a perspective view of center piece BB of the Frustum Puzzle.
Figure 15A:
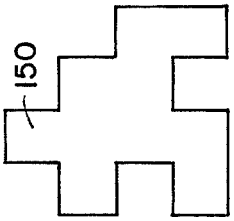
FIG. 15*a* is a top view of center piece BB of FIG. 15.
Figure 16:
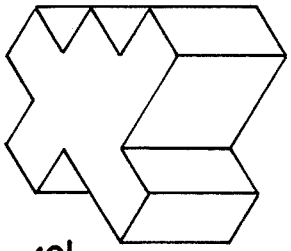
FIG. 16 is a perspective view of center piece CC of the Frustum Puzzle.
Figure 16A:
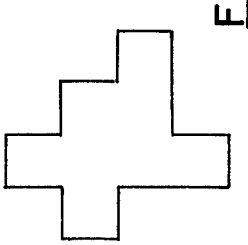
FIG. 16*a* is a top view of center piece CC of FIG. 16.

The first level has one center piece AA (FIG. 14) having indent 140 that receives projection 100 on side piece D (FIG. 10). The first level also has center piece BB (FIG. 15) which has a projection 150 which is positioned between the two projections 90 on two of side pieces C (FIG. 9); however center piece BB, in the actual puzzle is inverted (upside down) from its position shown in FIG. 15*a*.

A top view of the second level of FIG. 1 is shown in FIG. 24. It comprises four corner pieces CP, eight side pieces A, B, C and D of FIGS. 7 to 10 respectively, and three center pieces EE, FF and GG of FIGS. 18 to 20 respectively.

A top view of the third level of FIG. 1 is shown in FIG. 25 and consists of a center piece CC (FIG. 16), four corner pieces (FIG. 6), three side pieces C (FIG. 9) and one side pieces D (FIG. 10).

The fourth layer of FIG. 1 consists of four corner pieces (FIG. 6).

Figure 11:
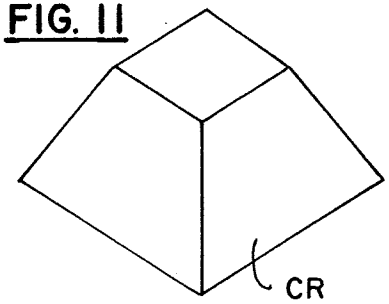
FIG. 11 is a perspective view of the crown of the Frustum Puzzle.
Figure 10A:
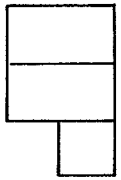
FIG. 10*a* is a top view of side piece D of FIG. 10.
Figure 10C:
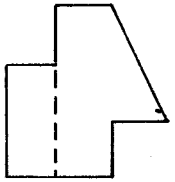
FIG. 10*c* is a side view of side piece D of FIG. 10.
Figure 10B:
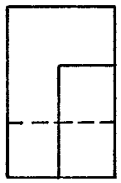
FIG. 10*b* is an inside, or rear, view of side piece D of FIG. 10.
Figure 11B:
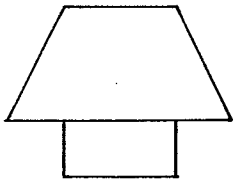
FIG. 11*b* is a side view of the crown of FIG. 11.
Figure 11A:
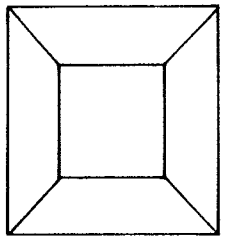
FIG. 11*a* is a top view of the crown of FIG. 11.
Figure 17:
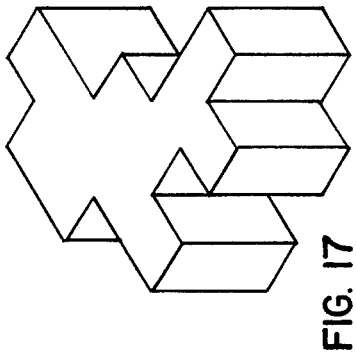
FIG. 17 is a perspective view of center piece DD of the Frustum Puzzle.
Figure 17A:
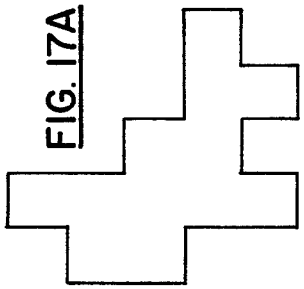
FIG. 17*a* is a top view of center piece DD of FIG. 17.
Figure 18:
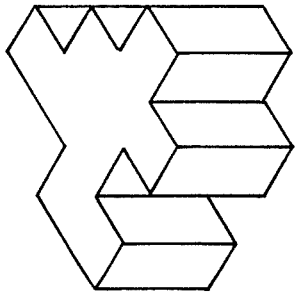
FIG. 18 is a perspective view of center piece EE of the Frustum Puzzle.
Figure 18A:
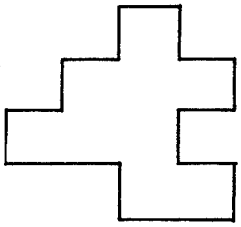
FIG. 18*a* is a top view of center piece EE of FIG. 18.
Figure 19:
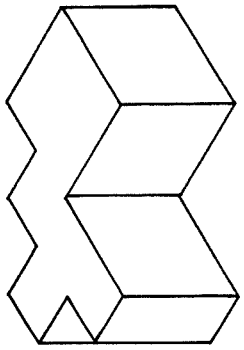
FIG. 19 is a perspective view of center piece FF of the Frustum Puzzle.
Figure 19A:
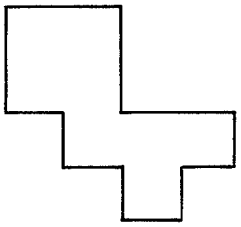
FIG. 19*a* is a top view of center piece FF of FIG. 19.
Figure 14:
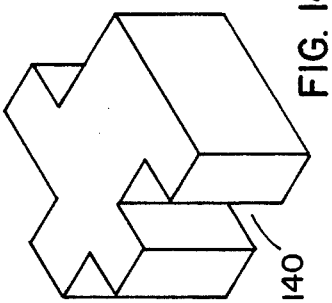
FIG. 14 is a perspective view of center piece AA of the Frustum Puzzle.
Figure 14A:
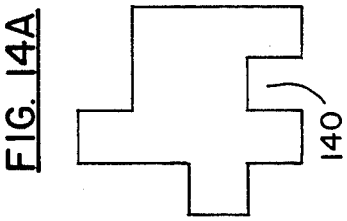
FIG. 14*a* is a top view of center piece AA of FIG. 14.

The fifth layer of FIG. 1 consists of the crown CR of FIG. 11.

The side walls W of each of the several side pieces of the second and third layers mate with the upper side wall UW of the side pieces of the layer below it. Further, the surface S of each of the side pieces rests on the horizontal top surface T of the side pieces below it.

In order to produce the Frustum Puzzle, sixteen corner pieces CP, three side pieces A, four side pieces B, seven side pieces C, eight side pieces D, one side piece E, one side piece F, one each of center pieces AA to HH, one base BE, and one crown CR are used. There is only one known way that all of these parts can be put together to form a frustum puzzle. This latter statement is subject to the understanding that identical parts may be substituted for each other; that is to say, for example, where a side piece B is called for any one of the four identical side pieces B may be used.

The particular way that the various pieces of levels 1, 2 and 3 go together is determined by the shapes of the inner walls of the various side pieces in cooperation with the shapes of the various center pieces.

Figure 26:
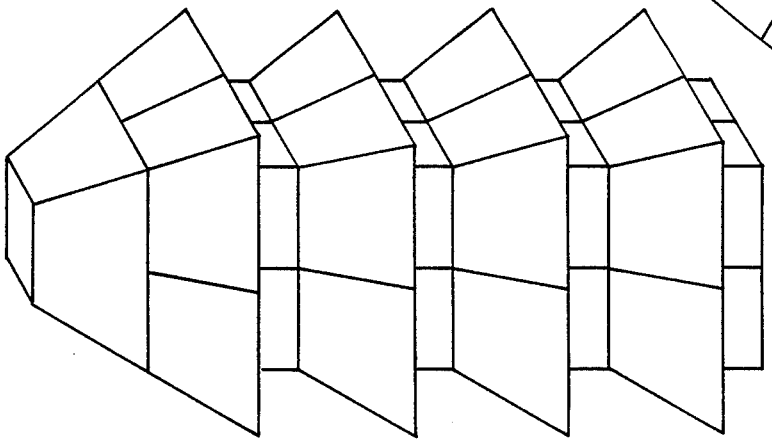
FIG. 26 is a perspective view of a Pagoda composed of 16 corner pieces of FIG. 6 and a crown of FIG. 11.
Figure 29:
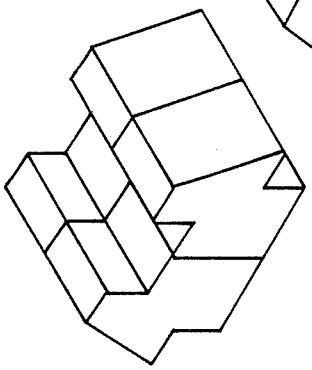
FIG. 29 is a perspective view of another device. This device may be constructed of four side pieces B (FIG. 8), or four side pieces C (FIG. 9), or four side pieces D (FIG. 10), or two side pieces A (FIG. 7) and two side pieces B (FIG. 8).
Figure 28:
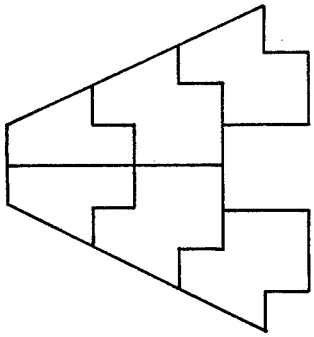
FIG. 28 is a front view of the A-House of FIG. 27.
Figure 27:
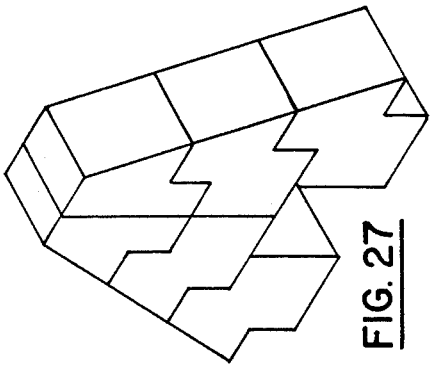
FIG. 27 is a perspective view of an A-House built with two side pieces A (FIG. 7) and four side pieces B (FIG. 8).

Some of the various pieces may be used to form other configurations. For example, the sixteen corner pieces CP and the crown CR may be assembled to form the pagoda of FIG. 26. As shown in FIGS. 27 and 28, an A-House may be assembled from two side pieces A and four side pieces B. Moreover, as shown in FIG. 29 a special figure can be formed of four side pieces B or four side pieces C; or two side pieces A and two side pieces B.

Figure 30:
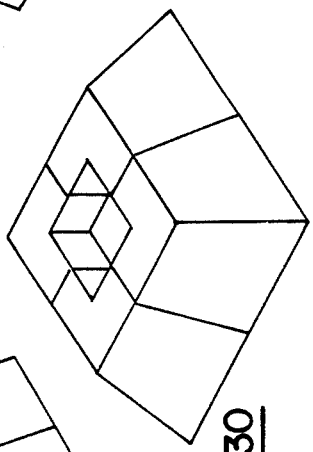
FIG. 30 is a perspective view of another device; this one being composed of four corner pieces of FIG. 6.

As shown in FIG. 30 a figure may be formed with four corner pieces.

Figure 31:
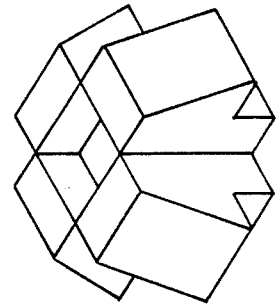
FIG. 31 is a perspective view of another device composed of four side pieces C (FIG. 9) or four side pieces D (FIG. 10) or two side pieces C (FIG. 9), one side piece A (FIG. 7), and one side piece B (FIG. 8); or two side pieces D (FIG. 10) and one side piece A (FIG. 7) and one side piece B (FIG. 8).

Moreover, as shown in FIG. 31 a figure may be formed with four side pieces C, or four side pieces D, or two side pieces D and one side piece A and one side piece B.

Figure 33:
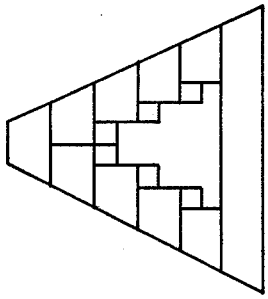
FIG. 33 is a side view of the monument of FIG. 32.
Figure 32:
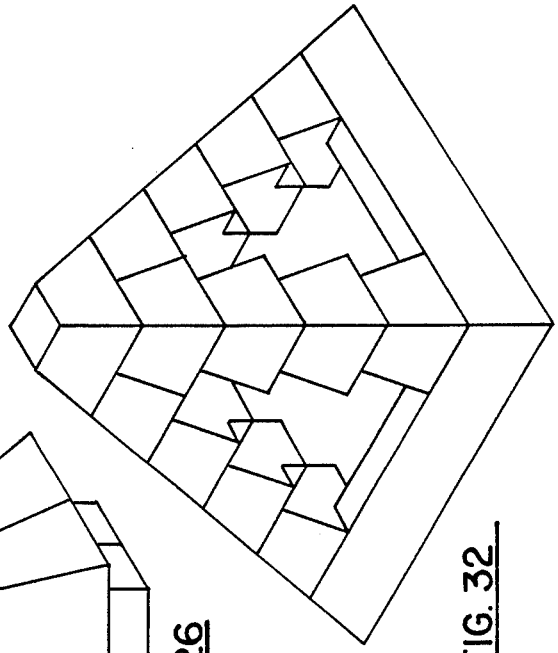
FIG. 32 is a perspective view of a monument composed of sixteen corner pieces (FIG. 6) a base (FIG. 22) and a crown (FIG. 11).

Furthermore, a monument may be made from the base the sixteen corner pieces CP and a crown CR, as shown in FIGS. 32 and 33.

The word "mate" as used in the specification and claims not only includes cases where a projection on one piece is in an indent in another piece but also cases where two parts are adjacent to each other as, for example, the relation of parts B and AA of FIG. 23.

I claim to have invented:

1. A multiplicity of puzzle pieces which may be positioned in a predetermined manner to form an assembled puzzle having at least two sets of pieces in first and second parallel planes, respectively, said puzzle pieces including side pieces, each side piece having an outside wall and an inner wall, the inner walls of at least several of said side pieces having different configurations, some of said puzzle pieces including side pieces, fitting together in the first of said planes for forming a first predetermined assemblage that has said outside walls around its periphery, said puzzle pieces including center piece means of a predetermined shape for mating with the inner walls of the side pieces of said first predetermined assemblage and for requiring the side pieces of said first predetermined assemblage to have a predetermined relationship with each other and with the center piece means before said center piece means will mate with the inner walls of said side pieces of said first predetermined assemblage, some of said puzzle pieces including side pieces, fitting together to form a second predetermined assemblage in said second plane and having overall outside dimensions smaller than the overall outside dimensions of the first predetermined assemblage, said puzzle pieces including another center piece means for said second predetermined assemblage, of a predetermined shape, for mating with the inner walls of the side pieces of said second predetermined assemblage and for requiring the side pieces of said second predetermined assemblage to have a predetermined relationship with each other and with said another center piece means before said another center piece means will mate with the inner walls of the side pieces of said second assemblage, said puzzle pieces of the first and second assemblages comprising means for forming a tapered structure in which the pieces in the first plane form a larger part of the tapered structure and the pieces in the second plane form a smaller part of the tapered structure, the pieces of said predetermined assemblage, forming said second assemblage, nesting into the pieces of said first plane.

2. A multiplicity of puzzle pieces as defined in claim 1, in which a side piece, of said second assemblage, is above a side piece of said first assemblage, said side piece, of said second assemblage, having a surface that is above said side piece which is part of said first assemblage, said side piece, of said first assemblage, having a top end mating with said surface.

3. A multiplicity of puzzle pieces as defined in claim 1, in which each of said first and second assemblages has a plurality of outside walls, said puzzle pieces including corner pieces, each having an outer wall, including a first corner piece that joins two of said outside walls of said first assemblage, and also including a second corner piece having an outer wall that joins two of said outside walls of said second assemblage, one of said corner pieces having an indent, the other of said corner pieces having a projection that mates with said indent for positioning said second corner piece above said first corner piece.

4. A multiplicity of puzzle pieces as defined in claim 1, in which there is (1) a first side piece with its inner wall being a flat surface, (2) a second side piece having a top, and an inner wall that has a flat upper wall surface extending downward from said top, and a projection mating with one of said center piece means and positioned further downward from said top than said upper wall, and (3) a third side piece which has a top and an upper inner wall extending downwardly from said top and which has projection means for mating with one of said center piece means, said projection means being below said upper inner wall of said third side piece and including two projections.

5. In a puzzle as defined in claim 1:

said puzzle having at least three side walls, each outside wall of each side piece tapering inwardly and upwardly and cooperating with other puzzle pieces to form at least portions of said three side walls of the puzzle with each such side wall of the puzzle formed as a substantially continuous substantially flat surface.

6. A multiplicity of puzzle pieces which may be positioned in a predetermined manner to form an assembled puzzle having at least two sets of pieces in first and second parallel planes, respectively, said puzzle pieces including side pieces, each side piece having an outside wall and an inner wall, the inner walls of at least several of said side pieces having different configurations, some of said puzzle pieces including side pieces, fitting together in the first of said planes for forming a first predetermined assemblage that has said outside walls around its periphery, said puzzle pieces including center piece means of a predetermined shape for mating with the inner walls of the side pieces of said first predetermined assemblage and for requiring the side pieces of said first predetermined assemblage to have a predetermined relationship with each other and with the center piece means before said center piece means will mate with the inner walls of said side pieces of said first predetermined assemblage, some of said puzzle pieces including side pieces, fitting together to form a second predetermined assemblage in said second plane and having overall outside dimensions smaller than the overall outside dimensions of the first predetermined assemblage, said puzzle pieces including another center piece means for said second predetermined assemblage, of a predetermined shape, for mating with the inner walls of the side pieces of said second predetermined assemblage and for requiring the side pieces of said second predetermined assemblage to have a predetermined relationship with each other and with said another center piece means before said another center piece means will mate with the inner walls of the side pieces of said second assemblage, said puzzle pieces of the first and second assemblages comprising means for forming a tapered structure in which the pieces in the first plane form a larger part of the tapered structure and the pieces in the second plane form a smaller part of the tapered structure, pieces which when assembled form layers of pieces in said first and second planes respectively as well as in a third plane which is parallel to the other two planes, said pieces for said first plane having four corner pieces for forming four corners and three side pieces between each pair of corner pieces, said pieces for said second plane having four corner pieces for forming four corners and two side pieces between each pair of corner pieces, said pieces for said third plane having four corner pieces for forming four corners and only one side piece between each pair of corner pieces, said pieces, when assembled, forming a frustum of a pyramid in which the second plane is above the first and the third plane is above the second one, a base for supporting the pieces in said first plane, said pieces of said first plane and the base being so shaped that the pieces of the first plane nest in the base.

7. A puzzle as defined in claim 6 in which four corner pieces are provided for a layer above said third plane.

8. A puzzle as defined in claim 7, having a crown that may be positioned above said last-named layer.

9. A puzzle comprising a multiplicity of puzzle pieces capable of assembly into at least first and second layers of progressively smaller cross section to thereby form a structure that tapers in cross section from one layer to the next, said puzzle pieces including side pieces and center pieces for the first layer, said center pieces comprising means for determining the particular form of the side pieces for said first layer, and the particular arrangement of such side pieces, that constitute said first layer, said puzzle pieces including side pieces and center piece means for the second layer, said center piece means determining the particular form of the side pieces for said second layer, and the particular arrangement of such side pieces, that constitute the second layer, said first section having larger overall cross section than said second layer and the walls of said pieces tapering inwardly and upwardly so that the assembled puzzle tapers and the side pieces of said second layer nesting in pieces of said first layer.

10. A puzzle as defined in claim 9, in which said nesting comprises:

each of the side pieces of said second layer extending above at least a part of a side piece of the first layer and also behind at least a part of a side piece of the first layer.

11. A puzzle as defined in claim 9 in which:

said puzzle having an outer wall, said puzzle pieces including: side pieces for said first layer each of which have (a) an outer wall which forms part of said outer wall of the puzzle and (b) an inner wall, said puzzle pieces also including: a side piece for said second layer which extends at least partially above at least one of said side pieces of said first layer and also has a projection extending downward behind at least a portion of the inner wall of at least one of said side piece of said first layer.

12. A puzzle as defined in claim 11, in which said side pieces form a part of the outer wall of said puzzle and taper inwardly and upwardly so that the outer wall of said puzzle tapers inwardly and upwardly.

13. A puzzle as defined in claim 9 in which each of said first and second layers have corners and inside walls, a first corner piece defining one of the corners of said first layer, a second corner piece defining one of the corners of said second layer and located at least partially above said first corner piece, one of said corner pieces having a projection which engages the inside wall of the other of said first and second corner pieces to position the pieces relative to one another, said first and second corner pieces having outer walls which taken together form part of the outer wall of said puzzle and taper inwardly with increasing height.

14. A puzzle as defined in claim 9 in which said first layer has at least first and second sides, said first layer having first and second side pieces on said first and second sides respectively and a first corner piece at the intersection of said first and second sides, said first corner piece having first and second sides, said first side piece being adjacent said first side of said first corner piece and said second side piece being adjacent said second side of said first corner piece, said second layer having a second corner piece above the corner piece of said first layer, said second corner piece also extending above at least a part of each of said first and second side pieces of said first layer, said second corner piece also extending downwardly and at least partially behind said first corner piece and at least partially behind said first and second side pieces of said first layer, said first and second side pieces and said first and second corner pieces having outside walls that taper so that such outside walls taper inward and upward.

15. A puzzle as defined in claim 9, comprising:

said first layer comprising at least three corner pieces defining corners of said first layer, at least one side piece between each adjacent pair of corner pieces of said first layer, each side piece of said first layer having an outside wall and an upper wall inside the puzzle, said second layer having a corner piece positioned above each corner piece of the first layer, each said corner piece of said second layer having a downwardly extending projection which extends behind at least a portion of said upper wall of at least one of said side pieces of said first layer and also extending behind at least a portion of the corner piece of said first layer below it, said corner pieces and said side pieces forming a structure having outside walls that taper upwardly and inwardly.

16. A puzzle as defined in claim 15 having a base for supporting said first layer.

17. In a puzzle as defined in claim 16: said base having an outer wall tapering inwardly and upwardly and a vertical inner wall.

18. In a puzzle as defined in claim 17: said base also having a top, each side piece having a top, each side piece of said first layer and each center piece of said first layer extending over at least a part of said top of said base and also along at least a part of the inner vertical wall of said base.

19. In a puzzle as defined in claim 9:

a third layer above said second layer, a fourth layer above said third layer, each of said four layers having four sides, four corners and a corner piece at each such corner, said first layer having three side pieces between the corner pieces of each of its said four sides, said second layer having two side pieces between the corner pieces of each of its four sides, said third layer having one side piece between the corner pieces of each of its four sides, the four corner pieces of the fourth layer constituting the entire fourth layer, each corner piece of the second, third and fourth layers extending at least partly above at least one corner piece and at least two side pieces of the layer immediately below it, and also extending behind at least a part of the corner piece and of two side pieces of the layer immediately below it, each side piece of the second and third layers extending at least both above and behind a part of two side pieces of the layer immediately below it, each of said side pieces, and each of said corner pieces, having an outer wall that tapers inwardly and upwardly, said outer walls forming a relatively smooth continuous outer surface of the puzzle.

20. In a puzzle as defined in claim 19:

a base supporting said first layer, said base having an inner vertical wall, a top, and an outer wall that tapers inwardly and upwardly, each corner piece and each side piece of said first layer extending both above and behind at least a portion of said base so that said first layer nests in said base.

21. In a puzzle as defined in claim 13:

said puzzle having side walls, each of said outer walls so tapering, and cooperating with each other, as to form substantially continuous, substantially smooth portions of the side walls said puzzle.

* * * * *